US012722045B2

(12) United States Patent
Stämpfli et al.

(10) Patent No.: US 12,722,045 B2
(45) Date of Patent: Sep. 1, 2026

(54) TRAINING APPARATUS

(71) Applicant: TomFit AG, Küsnacht (CH)

(72) Inventors: Thomas Stämpfli, Küsnacht (CH); Robert Kocher, Uster (CH)

(73) Assignee: TOMFIT AG, Küsnacht (CH)

( * ) Notice: Subject to any disclaimer, the term of this patent is extended or adjusted under 35 U.S.C. 154(b) by 0 days.

(21) Appl. No.: 19/126,277

(22) PCT Filed: Nov. 24, 2023

(86) PCT No.: PCT/EP2023/082985
§ 371 (c)(1),
(2) Date: May 1, 2025

(87) PCT Pub. No.: WO2024/115307
PCT Pub. Date: Jun. 6, 2024

(65) Prior Publication Data

US 2026/0115537 A1 Apr. 30, 2026

(30) Foreign Application Priority Data

Nov. 29, 2022 (EP) ..... 22210289

(51) Int. Cl.
*A63B 24/00* (2006.01)
*A63B 21/00* (2006.01)
*A63B 21/005* (2006.01)

(52) U.S. Cl.
CPC ..... *A63B 24/0087* (2013.01); *A63B 21/0059* (2015.10); *A63B 21/4027* (2015.10); *A63B 2208/0228* (2013.01)

(58) Field of Classification Search
CPC ..... A63B 21/0059; A63B 21/4027; A63B 24/0087; A63B 2208/0228
See application file for complete search history.

(56) References Cited

U.S. PATENT DOCUMENTS 10,758,774 B2 * 9/2020 Tholkes ..... A63B 22/001
11,458,354 B2 * 10/2022 Bissonnette ..... A63B 23/03516
(Continued)

FOREIGN PATENT DOCUMENTS

EP 2174694 A1 4/2010
GB 2510136 A 7/2014
(Continued)

OTHER PUBLICATIONS

Jan. 30, 2024 International Search Report issued in International Patent Appliation No. PCT/EP2023/082985.
(Continued)

*Primary Examiner* — Joshua Lee
(74) *Attorney, Agent, or Firm* — Oliff PLC

(57) ABSTRACT

A training apparatus including: an adjustable seat for an exerciser; a first, second and third control element, each individually configured to be moved from start position to end position and back again by exerciser sitting on the seat during exercise; a first force transmission unit which is connected to first control element, a second force transmission unit which is connected to second control element, and a third force transmission unit which is connected to third control element; at least one training resistance unit which is connected to force transmission units; and control unit; wherein the seat includes a seat surface and a backrest, wherein seat surface and backrest are designed to be adjustable independently of one another and wherein control unit is adapted to control training resistance unit and adjust the position of seat surface or the backrest or at least one of the control elements or combinations thereof.

8 Claims, 9 Drawing Sheets

(56) References Cited

U.S. PATENT DOCUMENTS

| | | | | |
|---|---|---|---|---|
| 11,458,363 | B2 * | 10/2022 | Powers | A63B 24/0062 |
| 11,801,419 | B2 * | 10/2023 | Bissonnette | A63B 23/12 |
| 11,801,423 | B2 * | 10/2023 | Bissonnette | A63B 24/0006 |
| 11,833,393 | B2 * | 12/2023 | Smith | A63B 24/0062 |
| 11,865,406 | B2 | 1/2024 | Hallor | |
| 11,896,540 | B2 * | 2/2024 | Mason | A63B 21/4029 |
| 11,904,207 | B2 * | 2/2024 | Bissonnette | A63B 24/0062 |
| 11,951,359 | B2 * | 4/2024 | Bissonnette | A63B 21/00178 |
| 11,957,956 | B2 * | 4/2024 | Bissonnette | A63B 21/015 |
| 11,957,960 | B2 * | 4/2024 | Bissonnette | A63B 21/4033 |
| 2007/0184952 | A1 * | 8/2007 | Matsubara | A63B 21/00178 482/148 |
| 2015/0072835 | A1 * | 3/2015 | Kunstmann | A63B 23/03525 482/4 |
| 2020/0269120 | A1 * | 8/2020 | Carter | A63B 71/0009 |
| 2020/0276470 | A1 * | 9/2020 | Howett | A63B 22/0664 |
| 2020/0376327 | A1 * | 12/2020 | Bissonnette | A63B 22/0605 |
| 2020/0391080 | A1 * | 12/2020 | Powers | G16H 50/50 |
| 2023/0064507 | A1 * | 3/2023 | McClain | A63B 21/4034 |

FOREIGN PATENT DOCUMENTS

| | | | |
|---|---|---|---|
| WO | 2009/143808 | A1 | 12/2009 |
| WO | 2020/212223 | A1 | 10/2020 |

OTHER PUBLICATIONS

Jan. 10, 2025 International Preliminary Report on Patentability issued in International Patent Application No. PCT/EP2023/082985.

* cited by examiner

TRAINING APPARATUS

The invention relates to a training apparatus and to a method for operation of the training apparatus.

Training apparatuses and rehabilitation equipment are used in sports and leisure facilities, such as sports halls, fitness studios, rehabilitation centers, clinics and similar facilities. In such facilities, athletes or users (hereinafter called exercisers) are expected to carry out gymnastic or rehabilitative sequences of exercises to improve fitness and/or health, also known as training sessions, which differ in terms of parameters according to the type of training or rehabilitation, the exerciser's physique, their state of health, the goals to be achieved, etc.

Generally speaking, after the characteristics of an exerciser have been checked by a trainer or supervisor, a "sequence" of exercises is established, i.e. a training plan, in which the conditions for carrying out the exercises are also defined. This training plan essentially represents the program to be carried out by the exerciser and is usually accompanied by a written list that the exerciser keeps with them during the training session in order to check how the exercises are being carried out. Different training plans differ essentially in terms of the number of exercises and also the sequence, duration and intensity of these.

It is beneficial for the exerciser to do full-body training in order to ensure balanced muscle development in the body and to avoid the risk of injury caused by weaker muscle groups. This usually includes a variety of exercises, also called training movements hereinafter, which work on all the major muscle groups of the body.

Experts define full-body training as training in which exercises from each of the following categories are carried out: upper body pull, upper body press, lower body pull, lower body press, hip closure and hip opening. The category of upper body pull includes exercises in which a pulling movement is carried out, against a resistance, by the muscles of the upper body, for example seated rowing or lat pull-down. The category of upper body press includes exercises in which a pressing movement is carried out, against a resistance, by the muscles of the upper body, for example a chest press or shoulder press. The category of lower body pull includes exercises in which a pulling movement is carried out, against a resistance, by the muscles of the lower body, for example leg curls. The category of lower body press includes exercises in which a pressing movement is carried out, against a resistance, by the muscles of the lower body, for example leg extension or leg press. The category of hip closure includes exercises in which the hip angle is closed against a resistance by the muscles of the torso, for example an abdominal press. The category of hip opening includes exercises in which the hip angle is opened against a resistance by the muscles of the torso, for example back extensions. By completing at least one exercise from each of the above categories, effective full-body training can be guaranteed.

Full-body training is usually performed on a variety of specialized apparatuses. For example, a leg press is used to exercise the legs, and a flat bench with a dumbbell holder is used for bench presses (abdominal press). However, since there are often several people exercising at the same time in fitness centers, there may be waiting times for using the various machines.

A possible alternative is to provide a single training apparatus with which full-body training can be performed.

One problem with full-body training entails the different settings that have to be made on each machine. Generally, the seat or the operating element of each machine has to be adjusted to the body size of the exerciser, in addition to the resistance. In this respect, a training plan includes not only the respective exercise, but also the sets and number of repetitions, and also the settings that have to be made on the machine. With training apparatuses that allow full-body training on the same machine, an annoying change-over to the next machine is not necessary, but even this training apparatus requires that the position of the seat and of the operating elements be adjusted individually for each exercise.

WO 2020/212223 A1 discloses a power training apparatus for strengthening the muscles in the upper body region and/or the muscles of the legs or torso. The power training apparatus comprises two seats and three manually actuatable operating elements which are coupled by a lever mechanism to at least one resistance-generating unit. The exerciser can perform various exercises using the respective operating element while sitting on the corresponding seat. For this purpose, the lever mechanism of the operating element is accordingly changed by means of a control unit. WO 2020/212223 A1 has the disadvantage that the exercises performed on it are limited, since its design does not allow for leg presses or secure rowing, for example, both of which are essential exercises for full-body training. Furthermore, the seats have to be mechanically adjusted by the user to his or her size and to the exercise that is to be performed. This is not only complex and time-consuming for the exerciser, but also dangerous, because it risks injury if the adjustment is not correct. Furthermore, it is unclear how the exercisers can be continuously accompanied by a digital trainer if they not only have to change seats, but also have to leave the seat in order to adjust it after almost every exercise.

EP 2174694 A1 discloses a system for creating and modifying training plans, in which the execution of the exercise is monitored by a computer and the training results are incorporated directly into the training plan. In this respect, there is no need for the training results to be written down. However, the convenience of performing all the exercises on the same apparatus is lost, as also is the ability to reserve this apparatus exclusively for the duration of the exercises. Switching from one apparatus to another has many disadvantages. Firstly, the exerciser has to clean and disinfect the surface of each apparatus. He then potentially has to wait at the next apparatus until the person currently using it has finished their exercise. He may then have to move away from his apparatus before he is ready, because a subsequent user is rushing him to do so. He also loses his digital trainer every time he changes apparatus, and he has to log in again on each apparatus. These are just the direct disadvantages of use. From an economic point of view, it is obvious that full-body training using a specially designed training apparatus with a space requirement of 6 $m^2$ and a cost of €20,000 can be set up much closer to or even directly at the exerciser's location, whereas full-body training using several specialized machines requires a space of 100 $m^2$ and a total cost of €120,000, which is only feasible for large fitness centers.

GB 2510136 A discloses a training apparatus with a circular frame to which operating elements are attached. The circular frame can rotate through a base unit in order to bring the operating elements to an appropriate training position.

WO 2009/143808 A1 discloses a training apparatus with at least one cable pull, the first end of which is coupled to a holding piece and the second end of which is coupled to an electric motor. The cable pull is guided over a roller, which is arranged on a trolley that can be moved over an arc-shaped, curved guide track.

The object of the invention is therefore to eliminate the disadvantages of the prior art and to provide a training apparatus and a method for operation of a training apparatus that enables the performance of full-body power training ideally tailored to the person exercising.

This object is achieved according to the invention by a training apparatus, and by a method for operating a training apparatus. Preferred embodiments of the invention are set forth below.

The invention relates to a training apparatus comprising a single adjustable seat for an exerciser, and also a first, a second and a third operating element. Each of the operating elements is individually configured to be moved from a start position to an end position and back again by an exerciser sitting on the seat during a training session. The training apparatus further comprises a first power transmission unit, which is connected to the first operating element, a second power transmission unit, which is connected to the second operating element, and a third power transmission unit, which is connected to the third operating element. The training apparatus further comprises at least one training resistance unit, which is connected to the power transmission units, and a control unit. The seat comprises a seat surface and backrest, wherein the seat surface and the backrest are designed to be adjustable independently of each other. The training apparatus according to the invention further differs from the prior art in that the control unit is adapted for controlling the training resistance unit and adjusting the position of the seat surface and of the backrest or at least one of the operating elements or combinations thereof.

In the context of the invention, the term "training resistance unit" is understood to mean a unit which exerts a resistance on an operating element, so that the exerciser can perform an exercise, to be carried out on the operating element, against a resistance.

The training apparatus according to the invention has the advantage that the control unit automatically adjusts the corresponding operating element and the seat to the exercise to be completed, as a result of which full-body training can be carried out on one machine and the tedious wait for a free training apparatus when changing between training exercises is therefore no longer necessary. A further advantage of the training apparatus according to the invention is that the exerciser does not have to remember the position of the seat and of the operating elements for the individual exercises, since the control unit does the adjustment for him. This avoids the risk of injury due to incorrectly positioned operating elements or to an incorrectly adjusted seat. A further advantage of the training apparatus according to the invention is that full-body training can be carried out in a shorter time, since there is no need to reconfigure the training apparatus and since the training apparatus therefore enables particularly efficient training. In addition, the automatic adjustment of the training apparatus also lowers the inhibition threshold for inexperienced exercisers such as senior citizens, since the training apparatus handles the configuration independently.

The possibility of reserving the apparatus for the duration of the full-body training further increases convenience and makes it easier to plan the training. A further advantage of the training apparatus according to the invention comprising a single seat is that the full-body training can be carried out without the exerciser having to leave the seat of the training apparatus, since the control unit automatically adjusts the corresponding operating element and the seat for the exercise that is to be completed. This increases the convenience of the training and further reduces the floor space required by the training apparatus, making the latter also suitable for home use or for small exercise rooms. A further advantage of the training apparatus according to the invention comprising three operating elements is that the training movements can be better distributed among the individual operating elements, so that these require less adjustment and/or enable better power transmission.

As has been described above, the seat comprises a seat surface and a backrest. In the context of the invention, this means that the seat surface and the backrest can be directly connected to each other or are connected only indirectly to each other and thus form a seat.

In the embodiment in which the seat surface and the backrest are not directly connected to each other, a passage is formed between the seat surface and the backrest, said passage being limited by the seat surface and the backrest. This construction allows an operating element to move through the passage between the seat surface and the backrest. For example, if it is intended to rotate under the seat for a change of position. This construction allows training in which the exerciser does not have to get up from the seat surface when the operating element changes from a first training exercise to a second training exercise.

In a preferred embodiment of the invention, the first operating element is designed in such a way that the muscles of the legs, the upper torso, the arms and the shoulders of the exerciser can be trained with it. Furthermore, the second operating element is designed in such a way that the muscles of the legs and the lower torso of the exerciser can be trained with it. Furthermore, the third operating element is designed in such a way that the muscles of the shoulders and the upper torso of the exerciser can be trained with it.

This division permits effective training of all the major muscle groups of the body.

The leg muscles include, among others, the following muscles: quadriceps femoris, gluteus, soleus, gastrocnemius, biceps femoris and sartorius.

The muscles of the upper torso include, among others, the following muscles: pectoralis major, pectoralis minor, deltoid, teres major, teres minor and latissimus dorsi.

The muscles of the arms include, among others, the following muscles: triceps brachii and biceps brachii.

The muscles of the lower torso include, among others, the following muscles: erector spinea, iliocostalis, longissimus, spinalis, rectus abdominis and obliquus externus abdominis.

The shoulder muscles include, among others, the following muscles: pectoralis major, pectoralis minor and deltoid.

To this end, at least one of the following training movements—leg press, rowing and chest press—is preferably carried out on the first operating element. At least one of the following training movements—leg curls, leg extensions, abdominal press back extensions—is preferably carried out on the second operating element. At least one of the following training movements—shoulder press and lat pull-down—is preferably carried out on the third operating element. The training movements mentioned above work the following muscles, among others:

Leg press: quadriceps femoris, gluteus maximus, soleus and gastrocnemius.

Rowing: teres major, teres minor, latissimus dorsi, deltoid and biceps brachii.

Abdominal press: pectoralis major, pectoralis minor, deltoid and triceps brachii.

Leg curls: biceps femoris, sartorius and gastrocnemius.

Leg extensions: quadriceps femoris and gluteus.

Abdominal press: rectus abdominis and obliquus externus abdominis.

Back extensions: erector spinea, iliocostalis, longissimus and spinalis.

Shoulder press: deltoid, triceps brachii, pectoralis major and obliquus externus abdominis.

Lat pulldown: latissimus dorsi, trapezius, teres major, teres minor and biceps brachii.

By dividing the training movements in this way among three operating elements, all of the larger muscle groups of the body can be trained particularly effectively. In particular, the shoulder press and/or lat pulldown movements can be carried out more efficiently using the third operating element.

In a preferred embodiment of the invention, the seat is arranged in the longitudinal direction between the first operating element and the third operating element, and the second operating element is arranged in the longitudinal direction laterally with respect to the seat. This arrangement of the operating elements has the advantage that the person exercising can comfortably access the training apparatus from the side, i.e. laterally, without the operating elements getting in the way.

Preferably, at least one of the operating elements is additionally designed as a securing element for securing an exerciser on the seat. Particularly preferably, the second and third operating elements are additionally designed as securing elements for securing an exerciser on the seat.

Since the user's own body weight is not sufficient as a counterweight to the resistance of the training apparatus during certain training movements, it may be necessary to secure the person exercising. Securing the exerciser by means of the operating elements has the advantage that no additional securing elements are required, in particular no handles that the exerciser has to hold on to. This means that the person exercising can concentrate fully on carrying out the training movement, without having to hold onto handles or the seat. Moreover, there is also no need to secure the person to the seat using a belt, which can be uncomfortable. Not least, the preferred embodiment described above reduces the risk of the exerciser being injured as a result of being poorly secured.

In a preferred embodiment of the invention, one of the operating elements is designed to be pivotable, preferably through 360°, about an axis of rotation oriented horizontally and perpendicular to the longitudinal direction. Particularly preferably, the second operating element is designed to be pivotable through 360° about an axis of rotation oriented horizontally and perpendicular to the longitudinal direction. The advantage of this particularly preferred embodiment is that the second operating element, due to its freedom of rotation about the axis of rotation, is suitable for carrying out a large number of training movements, including movements in opposite directions. By virtue of its rotation about the axis of rotation, the second operating element can thus be used both for leg curls and leg extensions. Moreover, the second operating element is also suitable both for abdominal presses and for back extensions.

Preferably, the adjustable seat comprises a seat surface and a backrest, which are both designed to be adjustable independently of each other. Particularly preferably, the seat surface or the seat can be moved in a vertical direction and horizontally along the longitudinal axis. Furthermore, in a preferred embodiment, the seat surface can also be tilted about a transverse axis, wherein the transverse axis is oriented vertically with respect to the vertical axis and vertically with respect to the longitudinal axis. The seat can therefore tilt or lift in the direction of the longitudinal axis with respect to the horizontal plane.

The individual adjustability of the seat surface and of the backrest means that the seat can be ideally adapted to the different body proportions of the persons exercising, so that each exerciser can perform all of the required exercises in a position that is ideal for that person. The backrest can be moved horizontally and its angle to the chair can be adjusted. It can therefore be optimally adjusted to each exercise and to each exerciser.

In a preferred embodiment of the invention, the training apparatus has a total weight of less than 800 kg. This facilitates transport and assembly of the training apparatus. Furthermore, on account of its lightweight construction, the training apparatus can also be placed on upper floors of buildings, which often have a lower load-bearing capacity than the ground floors.

In a preferred embodiment of the invention, the training apparatus has a second training resistance unit and preferably a third training resistance unit, each of the training resistance units being connected to the corresponding power transmission unit. By assigning each power transmission unit to a separate training resistance unit, the required power of the training resistance unit and thus its construction can be adapted exactly to the training movements carried out on the respective operating element. For example, for the training movements performed on the second operating element, such as leg extensions, less training resistance is required than with the first operating element, on which the leg presses can be performed. Thus, by directly assigning each operating element and the associated power transmission unit to a separate training resistance unit, the required performance can be optimized, which leads to significant cost savings.

Preferably, the training apparatus has a modular design, with each module having a weight of less than 300 kg.

By virtue of the modular design, the individual components of the training apparatus can be easily transported by two strong individuals, without the need for transport aids such as a forklift, a manually operated pallet truck or an elevator.

In a preferred embodiment of the invention, at least one power transmission unit is designed as a rocker. Particularly preferably, all of the power transmission units are designed as rockers.

The preferred embodiment of the power transmission units as a rocker or rockers enables the operating elements to be moved in opposite directions under load, without having to change the articulation points of the operating elements or of the power transmission units.

For example, in the case of a cable pull with plug-in weights, the pulley and thus the articulation point of the cable must be changed in order, for example, to perform bicep curls when standing and tricep presses when standing.

The design of the power transmission unit using a rocker makes it possible to perform shoulder presses and lat pulldowns with the same operating element, without having to reconfigure the training apparatus.

Preferably, the training resistance unit comprises an electric motor, preferably a servo motor or an AC motor, particularly preferably a servo motor.

The use of a servo motor or an AC motor as a resistance source has the advantage that a space-consuming weight stack is not required and, moreover, the training resistance can be adjusted continuously and automatically. The advantage of the preferred servo motor is also that the training resistance can be adjusted very precisely, which means that the training movement can be monitored and controlled more precisely.

The invention further relates to a method for operation of a training apparatus by an exerciser, comprising the following steps:

a) provision of a training apparatus, comprising a control unit, an adjustable seat, a first operating element and a second operating element.
b) verification of the exerciser at the control unit, as a result of which a predefined training plan is loaded into the control unit, and adjustment of the position of the seat and of at least one of the operating elements by the control unit according to the predefined training plan.
c) execution of a first training movement, wherein the exerciser moves one of the operating elements according to the training plan at least once from a start position to an end position and back again.
d) adjustment of the position of the seat and of at least one of the operating elements by the control unit according to the predefined training plan.
e) execution of at least one further training movement, wherein the exerciser moves one of the operating elements according to the training plan at least once from a start position to an end position and back again.
f) optionally, repetition of steps d) and e) until completion of the predefined training plan.

The method according to the invention has the advantage that the control unit automatically adjusts the corresponding operating element and the seat for the exercise that is to be performed, as a result of which full-body training can be carried out on a machine without the user having to leave the training apparatus or switch to another training apparatus. A further advantage of the training apparatus according to the invention is that the position of the seat and the position of the operating elements for the individual exercises are automatically adjusted by the control unit, and the person exercising does not have to remember these positions individually. It is thus possible to avoid or minimize a risk of injury caused by incorrectly positioned operating elements or an incorrectly adjusted seat. By virtue of the automatic adjustment of the positions and of the training resistance, it is possible to better evaluate the training results and to more precisely compare the success of training from one training session to the next.

A further advantage of the training apparatus according to the invention is that full-body training can be carried out in a shorter time, since there is no longer any need to manually reconfigure the training apparatus. Furthermore, the training apparatus can be adapted precisely to the needs of the exerciser through the combination of training plan and control unit, as a result of which overtraining is avoided and the risk of injury thus reduced. The continuous digital support, the automatic and individualized adjustment of the apparatus to the exerciser, and the possibility of reserving the training apparatus for the duration of the full-body training session create a new level of convenience which will encourage many people to train. The 15-fold reduction in the space required and the 5-fold reduction in costs will allow these apparatuses to be distributed in a much more targeted way so that, in addition to the increased convenience, a reduction in time expended will be permitted.

In the method according to the invention, the training apparatus preferably comprises a third operating element. Particularly preferably, first training movements selected from the group consisting of abdominal press, rowing and leg press are carried out on the first operating element. Particularly preferably, second training movements selected from the group consisting of leg curls, leg extensions, back extensions and abdominal press are carried out on the second operating element. Particularly preferably, third training movements selected from the group consisting of shoulder press and lat pulldown are carried out on the third operating element.

As has already been described for the training apparatus, the aforementioned three training movements address all the major muscle groups of the human body.

In a preferred embodiment of the method according to the invention, the training plan is loaded from a storage unit, particularly preferably from a cloud-based storage unit, onto the control unit.

A cloud-based storage unit the advantage of eliminating the need for a local server to store training plans in the training environment or in the building in which the training apparatus is located. This saves space and reduces energy costs that would be incurred with a local server.

Preferably, the training plan comprises at least one parameter selected from the group consisting of movement sequence, training resistance, duration of each phase of the movement, range of motion, seat configuration data, movement dynamics and number of movement repetitions.

These parameters all influence the training intensity and thus allow an individual adjustment of the training stimulus.

The invention is explained in more detail below on the basis of a number of exemplary embodiments shown in the figures. Where alternative embodiments differ only in terms of individual features, the same features have been designated by the same reference signs. The figures are purely schematic and show the following:

Figure 1:
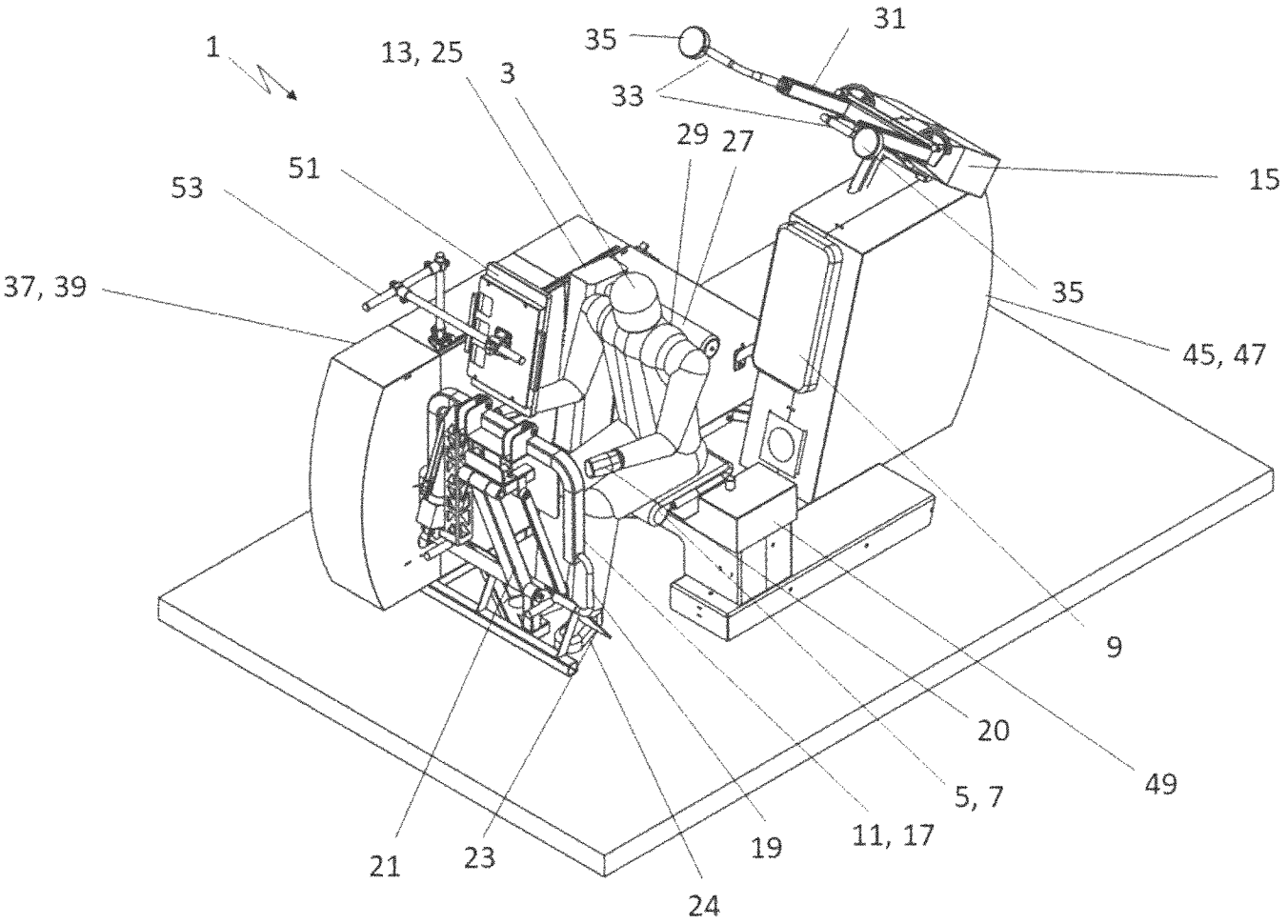
FIG. 1 shows a perspective view of a preferred embodiment of the training apparatus.
Figure 2:
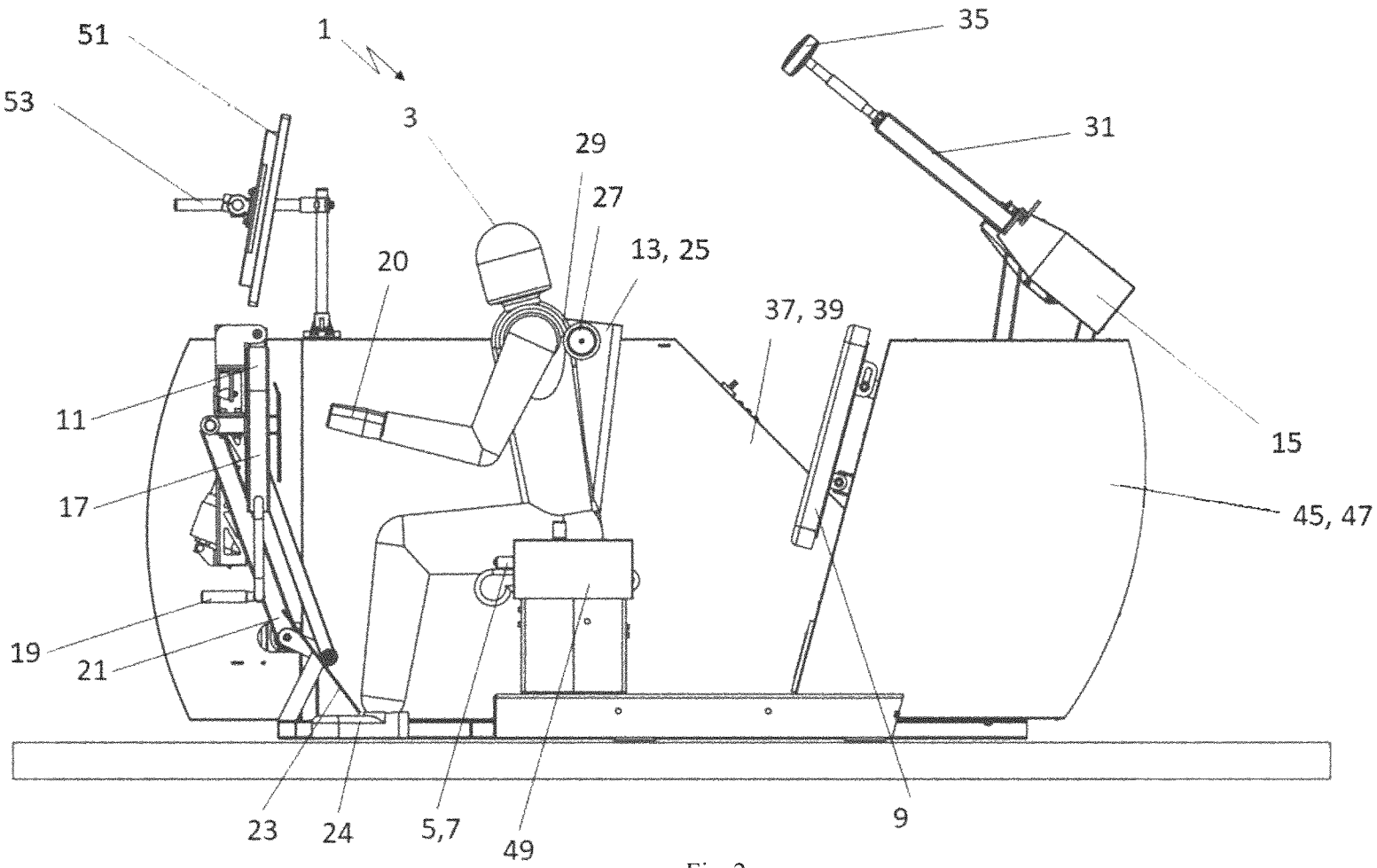
FIG. 2 shows a longitudinal section through the training apparatus according to FIG. 1.

FIGS. 1 and 2 show a preferred embodiment of the training apparatus 1 for an exerciser 3, comprising an adjustable seat 5 with a seat surface 7 and a backrest 9. The training apparatus 1 further comprises a first operating element 11, a second operating element 13 and a third operating element 15. The first operating element 11 comprises a first linkage lever 17 and two handles 19, arranged on the first linkage lever 17, for the hands 20 of the exerciser 3. The first operating element 11 further comprises a second linkage lever 21 and a plate 23, arranged on the second linkage lever 21, on which the feet 24 of the exerciser 3 can be positioned. In FIGS. 1 and 2, the first operating element 11 is folded in, since it is not used for the intended training movement. The second operating element 13 comprises a third linkage lever 25, and a contact element 27 which is fastened to the third linkage lever 25 and is in contact with the exerciser 3. In FIG. 1, the contact element 27 touches the upper region of the back 29 of the exerciser 3. The third operating element 15 comprises a fourth linkage lever 31, two handles 33 arranged on the fourth linkage lever 31 for the hands of the exerciser 3, and two retention elements 35 arranged on the handles 33. The third operating element 15 is folded up in FIG. 1, since it is not used for the training movement currently being performed. The training apparatus 1 further comprises a side box 37, which is covered with a cover 39, a front box 41 with a cover 43 (not shown), a rear box 45 with a cover 47, and a seat bracket 49. The backrest 9 is arranged on the rear box 45 and can be moved longitudinally toward or away from the exerciser 3. In addition, the backrest 9 can also be tilted so that it rests more steeply or more flatly on the rear box 45. The seat surface 7 is attached to the seat bracket 49 and can be moved up and down in a vertical direction and along the longitudinal axis in the direction of the first operating element 11 and back toward the backrest 9. In addition, the seat surface 7 can also be tilted in the direction of the first operating element 11 or raised in the direction of the backrest 9. The training apparatus 1 further comprises a screen 51 on which the exerciser 3 is shown information about the current training movement. Corresponding information includes, for example, the current number of repetitions completed, the programmed number of repetitions, the number of sets completed, the programmed number of sets, the current position of the operating element, the range of motion to be completed or the next training movement to be completed. The screen 51 is attached to a rail (not shown here) via a suspension 53 and can move forward and back along the rail in the longitudinal direction, so that the exerciser 3 can easily read the information displayed on the screen 51.

Figure 3:
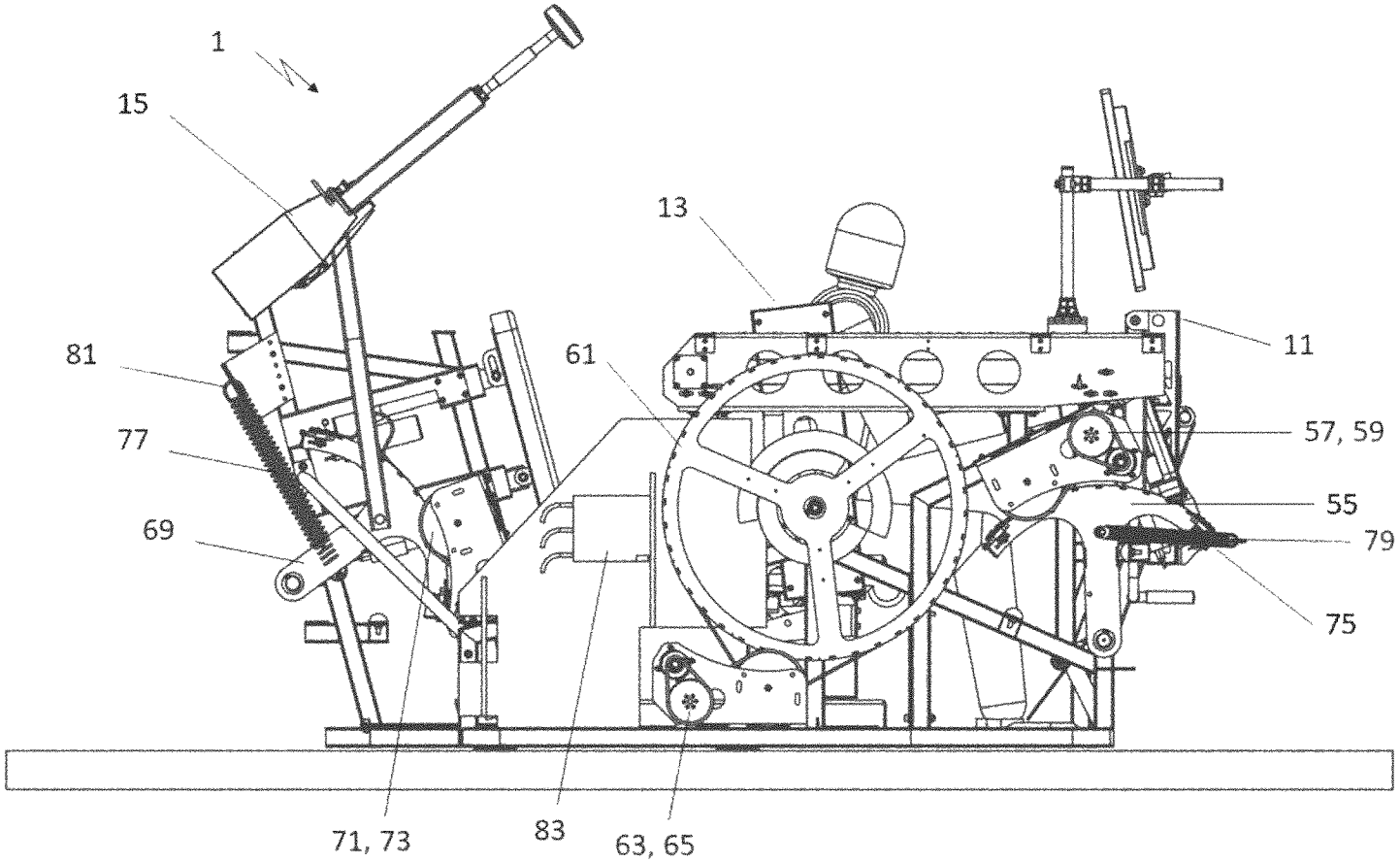
FIG. 3 shows a side section through the training apparatus without cover according to FIG. 1.

FIG. 3 shows a side view of a preferred embodiment of the training apparatus 1, in which the cover 39 of the side box 37 has been removed so that the inner construction is visible. The first operating element 11 is connected to a first power transmission unit 55, wherein the first power transmission unit 55 is designed here as a rocker with a range of motion of approximately 90°. The first power transmission unit 55 is connected via a first gear system 57 to a first training resistance unit 59. The first training resistance unit 59 is designed here as a servo motor. The second operating element 13 is connected to a second power transmission unit 61, the second power transmission unit 61 being designed here as a rocker with a range of motion of 360. The second power transmission unit 61 is connected via a second gear system 63 to a second training resistance unit 65, the second training resistance unit 65 also being designed as a servo motor. The third operating element 15 is connected to a third power transmission unit 69, the third power transmission unit 69 being designed here as a rocker with a range of motion of approximately 90°. The third power transmission unit 69 is connected via a third gear system 71 to a third training resistance unit 73, the third training resistance unit 73 also being designed as a servo motor. To relieve the first and third training resistance units 59, 73 of the weight of the first and third operating elements 11, 15, the first and third power transmission units 55, 67 are each attached to articulation points 79, 81 via springs 75, 77. FIG. 3 also shows a control unit 83 which is installed in the side box 37 and from there controls the positioning 44 the seat surface 7, the backrest 9, the three operating elements 11, 13, 15, and the training resistance units 59, 65, 73. The position of the three operating elements 11, 13, 15 is regulated via the three training resistance units 59, 65, 73.

Figure 4:
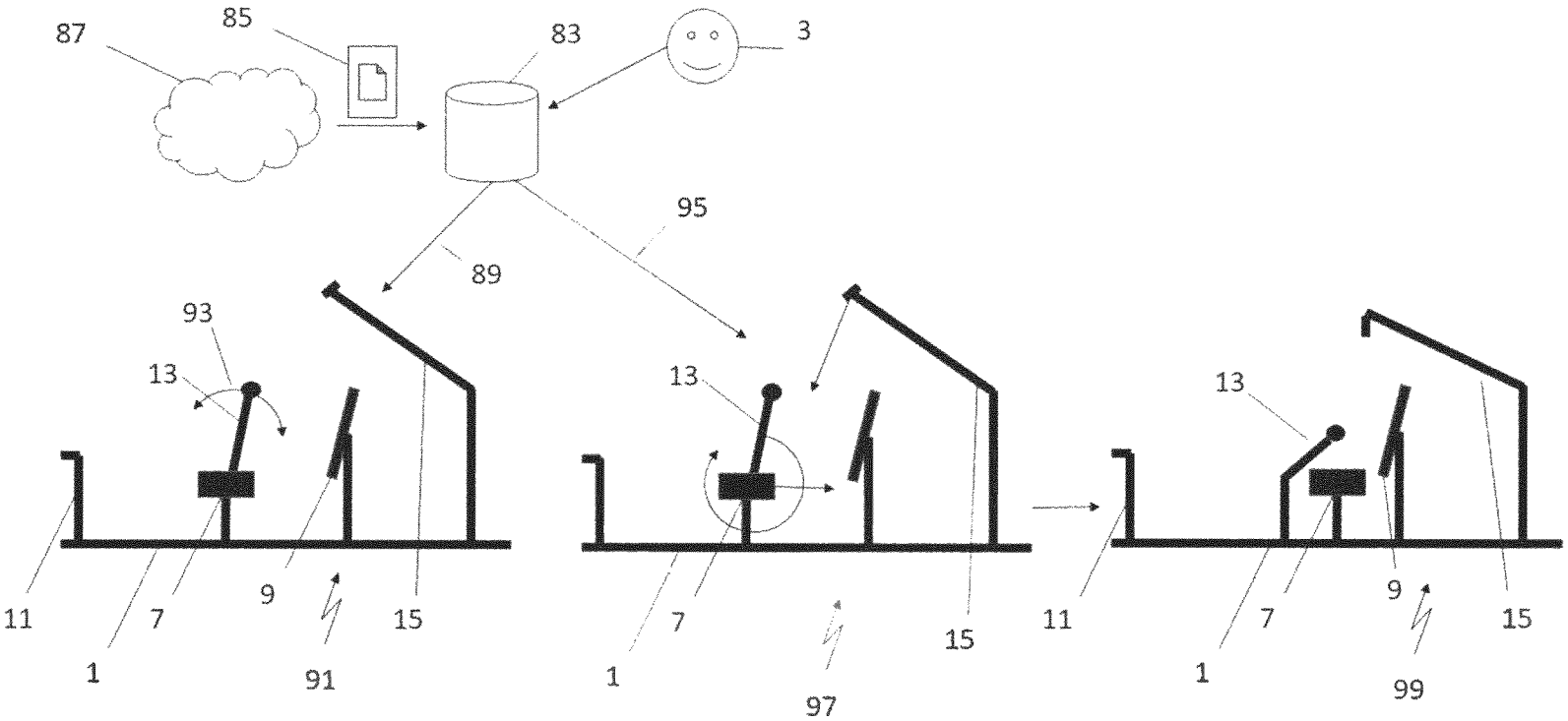
FIG. 4 shows a schematic representation of a preferred embodiment of the method.

FIG. 4 shows a schematic representation of a preferred embodiment of the method according to the invention. At the start of the training session, the exerciser 3 sits down on the seat surface 7 of the seat of the training apparatus 1 and registers themselves on the control unit 83 of the training apparatus 1, in doing so acknowledging the reservation made by them on the apparatus. After registration has been completed, the control unit 83 loads a training plan 85 from a cloud-based storage unit 87 onto the control unit 83 and retrieves the first training apparatus configuration 89 stored therein. In the first training apparatus configuration 89, the training apparatus 1 is set for the first training movement 91 (here, back extension). The first operating element 11 is moved backward to provide space for the training movement, and the third operating element 15 is moved upward. Moreover, the seat surface 7 is moved forward that it is at the level of the axis of rotation of the second operating element 13 and is adjusted in height to the size of the exerciser 3. The second operating element 13 is moved under the seat 5 to the back of the exerciser 3 and is adjusted in height to the size of the exerciser 3. The exerciser 3 is instructed by the digital trainer to lift their legs slightly. The resistance with which the operating element 13 is moved is so low that it cannot injure anyone. The digital trainer signals to the exerciser 3 that the configuration of the training apparatus 1 is complete and that the first training movement 91 can be begun. The exerciser 3 begins the first training movement 91 by applying pressure to the second operating element 13 with their back. During the training movement (back extension), the exerciser 3 moves the second operating element 13 back and forth along a path 93 provided for this purpose in accordance with the training plan 85, until they have reached the number of repetitions specified by the training plan 85. The control unit 83 can regulate the range of motion along the path 91 and increase or reduce the resistance applied to the second operating element 13 if the control unit recognizes that this is necessary, for example if the exerciser 3 is becoming tired. When the exerciser 3 has completed the first training movement 91 (back extension) according to the training plan 85, they can remain sitting on the seat surface 7 while the control unit 83 configures the training apparatus 1 for the next training movement 99. To do this, the storage unit 83 calls up the second training apparatus configuration 95 and, during a conversion phase 97, configures the training apparatus 1 accordingly for the second training movement 99 (here lat pulldown). During the conversion phase 97, the second operating element 13 is first rotated backward so that it can rotate downward between the seat surface 7 and the backrest 9 and then rotates further forward beneath the seat in the direction of the first operating element. The seat surface 7, with the exerciser 3 sitting on it, is moved backward in the direction of the backrest 9. In the end position of the seat surface 7, the back of the exerciser 3 sitting on the seat surface 7 touches the backrest 9. The second operating element 13 secures the exerciser on the seat surface 7 by applying pressure to the thighs. Finally, the third operating element 15 is moved from an elevated position into the starting position for the lat pulldown, which starting position is adapted to the body size of the exerciser 3. After the conversion phase 97 has been completed, the exerciser 3 can complete the second training movement 99 (lat pulldown) on the training apparatus 1. For the further training movements predefined by the training plan 85, the training apparatus 1 is adjusted, in a further conversion phase, to the next training movement, without the exerciser 3 having to leave the seat.

Figure 5:
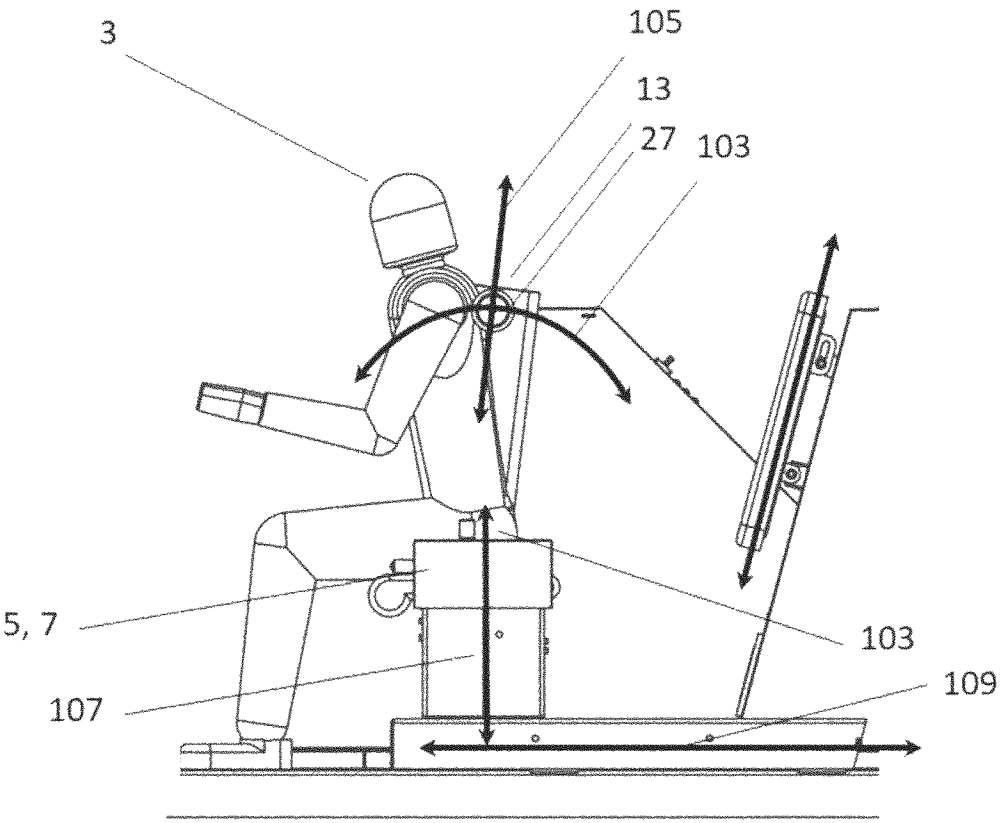
FIG. 5 shows a detail of a longitudinal section through the training apparatus according to FIG. 1.

FIG. 5 shows the exerciser 3 performing a back extension exercise. The exerciser 3 is sitting on the seat surface 7 of the adjustable seat 5. During the back extension exercise, the second operating element 13 is moved along a circular path 101 about a rotation point 103. The rotation point 103 is located at the level of the hip joint of the exerciser 3. To allow the exercise to be performed in an ideal manner, the second operating element 13 has to be adjusted to the body proportions of the exerciser 3. For this purpose, the length of the second operating element 13 along a lever path 105 can be adjusted to the body proportions of the exerciser 3 so that the contact element 27 is arranged at the level of the shoulder blades of the exerciser 3. For this purpose, the seat surface is adjusted along the seat height axis 107 and the seat longitudinal axis 109 so that the waist of the exerciser 3 is aligned with the rotation point 103 of the second operating element 13. The adjustment of the position of the seat surface 7 and of the second operating element 13 and the body proportions of the exerciser are necessary in order to avoid incorrect loading of the exerciser 3 during training.

Figure 6:
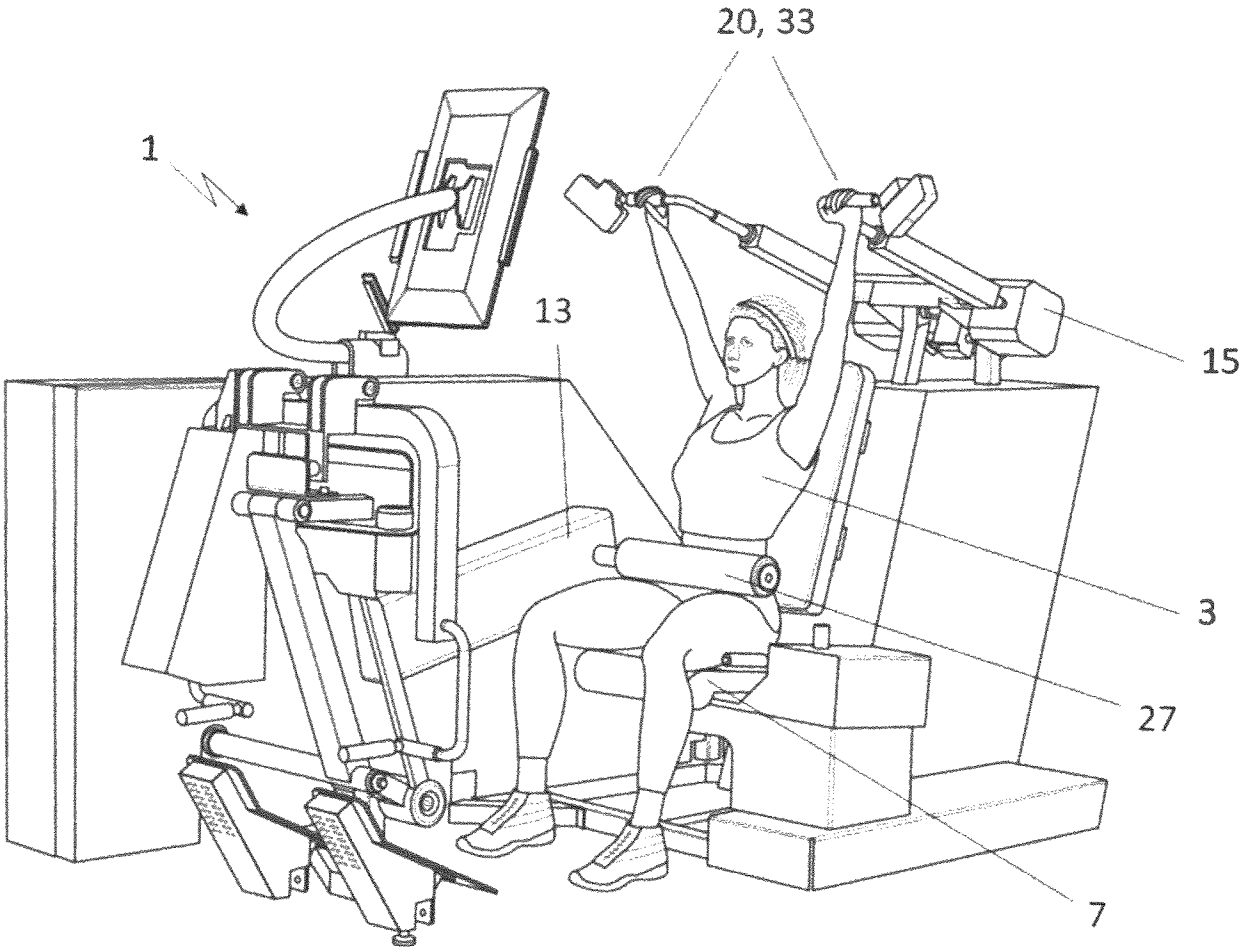
FIG. 6 shows a perspective side view of the training apparatus according to FIG. 1.

FIG. 6 shows a perspective view of the training apparatus 1 in which the exerciser 3 is currently performing the lat pulldown exercise. The exerciser 3 is sitting on the seat surface 7 and is holding the handles 33 of the third operating element 15 with their hands 20. During the lat pulldown exercise, the handles 33 of the third operating element 15 are moved counter to a resistance from a start position (top, shown) to an end position (bottom, not shown) and then back again. If the resistance were greater than the weight of the exerciser 3, the latter would be lifted off the seat 7 and would perform a pull-up instead of a lat pulldown. To secure the exerciser 3 on the seat surface 7, the second operating element 13 is positioned such that the contact element 27 of the second operating element 13 is in contact with the top of the legs of the exerciser 3 and thus prevents the exerciser 3 from being lifted off the seat surface 7.

Figure 7:
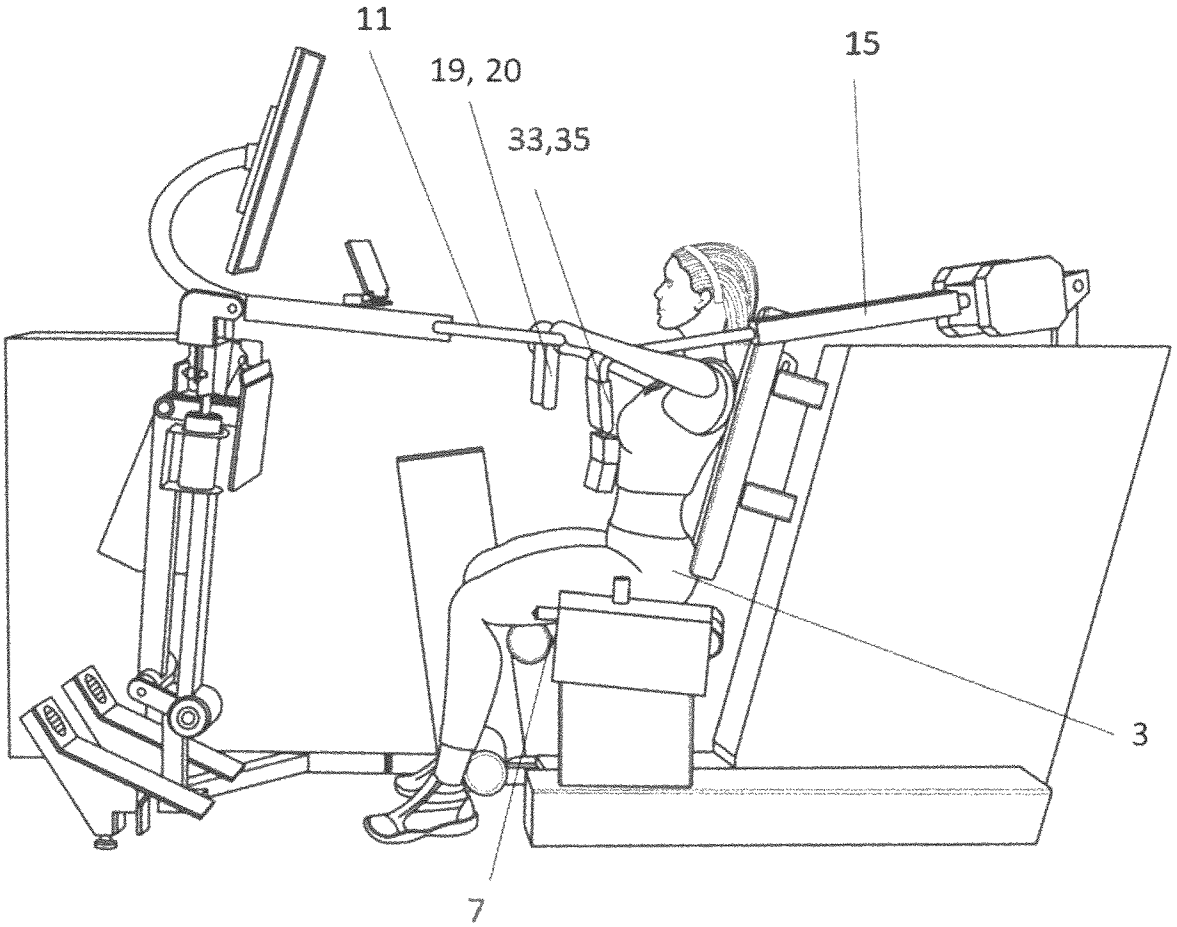
FIG. 7 shows a perspective side view of the training apparatus according to FIG. 1.
Figure 8:
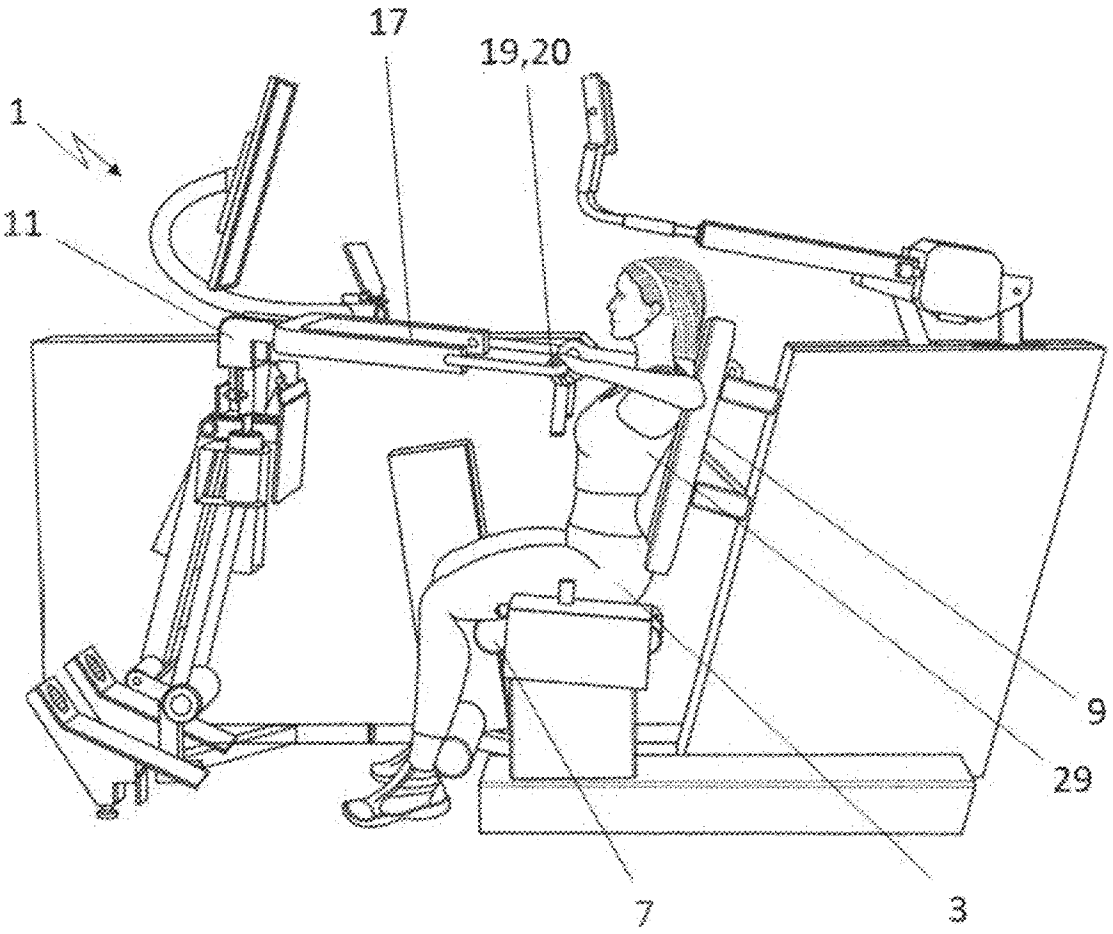
FIG. 8 shows a side view of the training apparatus according to FIG. 1.

FIG. 7 shows a perspective view of the training apparatus 1, in which the exerciser 3 is currently performing a rowing exercise. The exerciser 3 is sitting on the seat surface 7 and is holding the handles 19 of the first operating element 15 with both hands 20. During the rowing exercise, the handles 19 of the first operating element 11 are moved, counter to a resistance, from a start position (away from the chest, not shown) to an end position (close to the chest, shown) and then back again. Even with little resistance, the exerciser 3 would not apply enough weight and would pull away from the seat 7. To secure the exerciser 3 on the seat surface 7, the third operating element 15 is positioned such that the retention elements 35 on the handles 33 are in contact with the chest of the exerciser 3, thus preventing the exerciser 3 from being pulled away from the seat surface 7. FIG. 8 shows a side view of a preferred embodiment of the training apparatus 1, in which the exerciser 3 is performing an abdominal press exercise (bench press). For this purpose, the exerciser 3 sits on the seat surface 7 with their back 29 in contact with the backrest 9. During the abdominal press exercise, the hands 20 of the exerciser 3 grasp the handles 19 of the first operating element 11 and move these, counter to a resistance, from a start position (shown) to an end position (arms stretched straight out forward, not shown) and then back again. To perform the abdominal press exercise, the first linkage lever 17 of the first operating element 11 is folded up (oriented substantially parallel to the floor) and aligned such that exerciser 3 pushes the handles forward along a path substantially parallel to the floor, until the elbow joints are fully extended.

Figure 9:
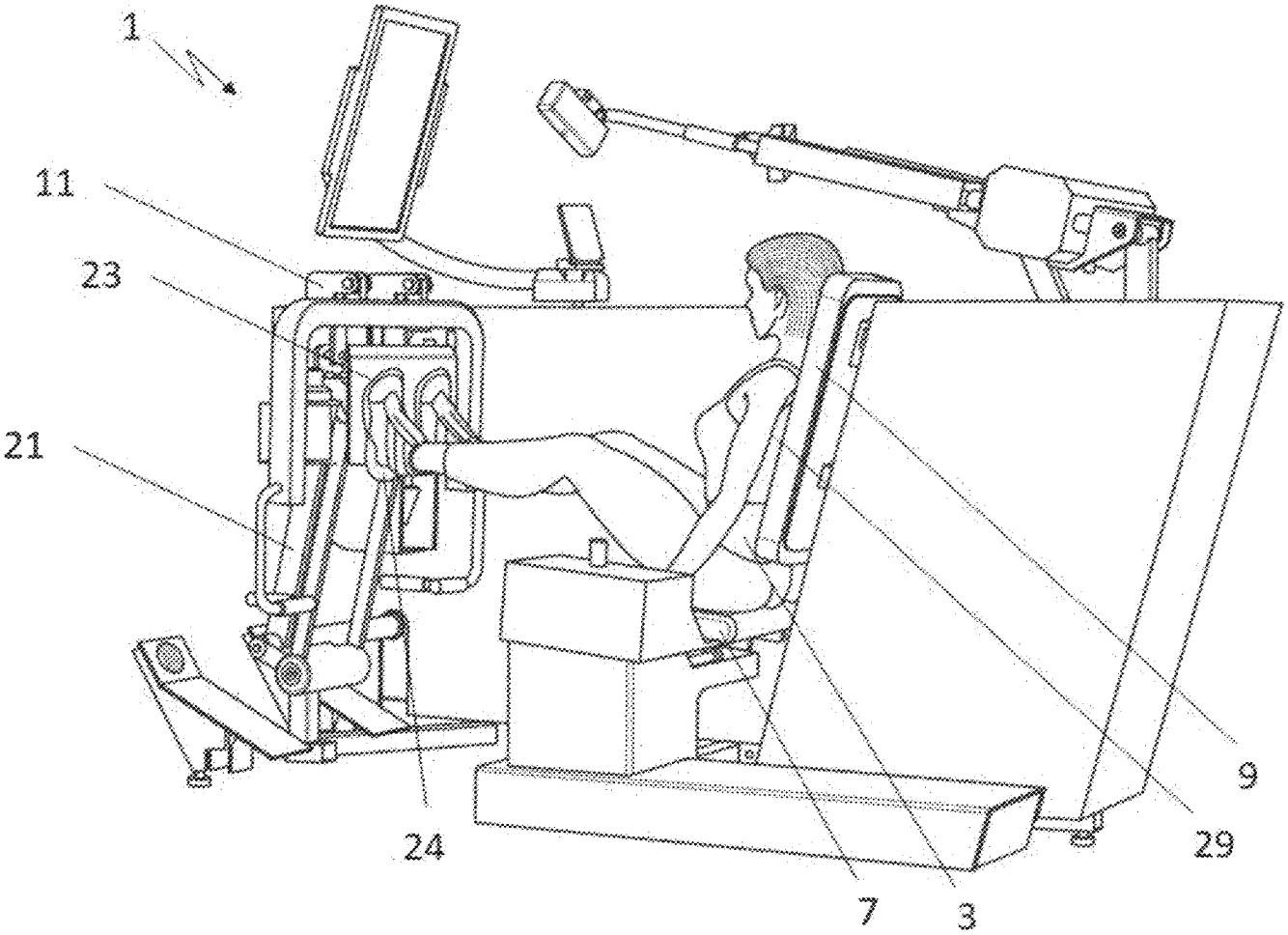
FIG. 9 shows a perspective side view of the training apparatus according to FIG. 1.

FIG. 9 shows a perspective view of a preferred embodiment of the training apparatus 1, in which the exerciser 3 is performing a leg press exercise. For this purpose, the exerciser 3 sits on the seat surface 7, with their back 29 in contact with the backrest 9. During the leg press exercise, the exerciser 3 places their feet 24 on the plate 23 and moves the latter, counter to a resistance, from a start position (not shown) to an end position (shown) and then back again. The plate 23 is connected to the first operating element 11 via the second linkage lever 21.

The invention claimed is:

1. A training apparatus for performing full-body power training, comprising:

a single adjustable seat for an exerciser;

a first, a second and a third operating element, each individually configured to be moved from a start position to an end position and back again by an exerciser sitting on the seat during a training session;

a first power transmission unit, which is connected to the first operating element, a second power transmission unit, which is connected to the second operating element, and a third power transmission unit, which is connected to the third operating element;

at least one training resistance unit, which is connected to the power transmission units;

and a control unit;

wherein the seat comprises a seat surface and backrest, wherein the seat surface and the backrest are designed to be adjustable independently of each other, and the seat surface can be moved forward horizontally along a longitudinal axis and back in the direction of the backrest, and wherein the control unit is adapted for controlling the training resistance unit; and adjusting the position of the seat surface and of the backrest and of at least one of the operating elements.

2. The training apparatus as claimed in claim 1, wherein the first operating element is designed in such a way that the muscles of the legs, the upper torso and the shoulders of the exerciser can be trained with it, and that the second operating element is designed in such a way that the muscles of the legs and the lower torso of the exerciser can be trained with it, and that the third operating element is designed in such a way that the muscles of the shoulders and the upper torso of the exerciser can be trained with it.

3. The training apparatus as claimed in claim 1, wherein the seat is arranged in the longitudinal direction between the first operating element and the third operating element; and the second operating element is arranged in the longitudinal direction laterally with respect to the seat.

4. The training apparatus as claimed in claim 1, wherein at least one of the operating elements, are additionally designed as securing elements for securing an exerciser on the seat.

5. The training apparatus as claimed in claim 1, wherein the second operating element is designed to be pivotable through 360° about an axis of rotation oriented horizontally and perpendicular to the longitudinal direction.

6. The training apparatus as claimed in claim 1, wherein the training apparatus comprises a second training resistance unit, wherein each of the training resistance units is connected to the corresponding power transmission unit.

7. The training apparatus as claimed in claim 1, wherein the training resistance unit comprises an electric motor.

8. A method for operation of a training apparatus by an exerciser, comprising the following steps:

a. provision of a training apparatus as claimed in claim 1, comprising a control unit, an adjustable seat, a first operating element, a second operating element and a third operating element;

b. verification of the exerciser at the control unit, as a result of which a predefined training plan is loaded into the control unit, and adjustment of the position of the seat surface and of the backrest and of at least one of the operating elements by the control unit according to the predefined training plan;

c. execution of a first training movement, wherein the exerciser moves one of the operating elements according to the training plan at least once from a start position to an end position and back again;

d. adjustment of the position of the seat surface and of the backrest and at least one of the operating elements by the control unit according to the predefined training plan;

e. execution of at least one further training movement, wherein the exerciser moves one of the operating elements according to the training plan at least once from a start position to an end position and back again;

f. optionally, repetition of steps d) and e) until completion of the predefined training plan.

* * * * *